US006973873B2

(12) United States Patent
Salisbury

(10) Patent No.: US 6,973,873 B2
(45) Date of Patent: Dec. 13, 2005

(54) ONE-PIECE INJECTION-MOLDED OR CAST SILK SCREEN FRAME

(76) Inventor: Ronald Salisbury, 1010 University Ave. #912, San Diego, CA (US) 92103

( * ) Notice: Subject to any disclaimer, the term of this patent is extended or adjusted under 35 U.S.C. 154(b) by 48 days.

(21) Appl. No.: 10/656,719

(22) Filed: Sep. 8, 2003

(65) Prior Publication Data

US 2005/0051042 A1 Mar. 10, 2005

(51) Int. Cl.[7] ..... B41L 13/00
(52) U.S. Cl. ..... 101/127.1; 101/127; 101/128.4
(58) Field of Search ..... 101/127, 127.1, 101/128.4, 126, 128.1

(56) References Cited

U.S. PATENT DOCUMENTS 1,901,963 A * 3/1933 Hansen ..... 38/102.5
3,167,004 A * 1/1965 Miller et al. ..... 101/127.1
4,186,660 A * 2/1980 Key ..... 101/128.1
5,097,761 A * 3/1992 Hamu ..... 101/127.1
5,255,600 A * 10/1993 Hamu ..... 101/127.1
5,379,691 A * 1/1995 Hamu et al. ..... 101/127.1
6,435,085 B1 * 8/2002 York ..... 101/127.1
6,588,334 B2 * 7/2003 Salisbury ..... 101/127.1
6,681,830 B1 * 1/2004 Vulpitta et al. ..... 156/527
6,776,090 B2 * 8/2004 Takenaka et al. ..... 101/127

* cited by examiner

*Primary Examiner*—Ren Yan
*Assistant Examiner*—Dave A. Ghatt
(74) *Attorney, Agent, or Firm*—Steven W. Webb

(57) ABSTRACT

An improved screen printing frame is presented that is cast from one piece of plastic material and possesses support ribs to confer additional strength to the structure. The frame is designed to be produced by a low-cost single-mold casting process and to permit the attachment of screens by adhesive means.

3 Claims, 5 Drawing Sheets

Fig. 2
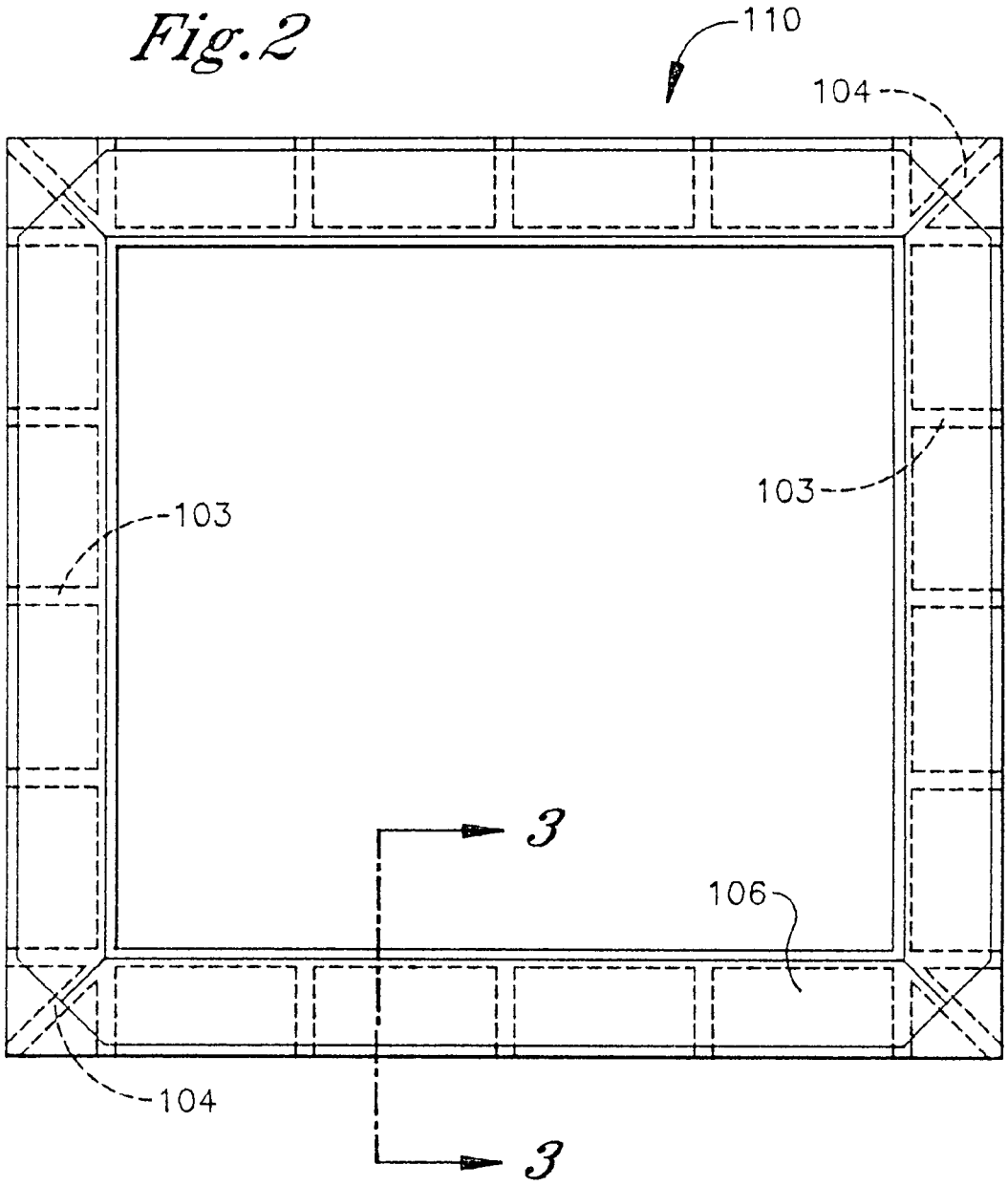
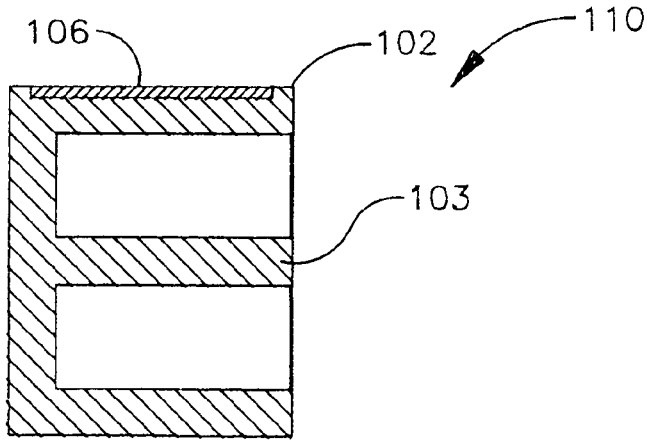
Fig. 3

110
114
102
115

ONE-PIECE INJECTION-MOLDED OR CAST SILK SCREEN FRAME

BACKGROUND OF THE INVENTION

This invention relates to rectangular or square screen printing frames and in particular to an improvement in screen printing frame design and manufacture.

Existing rectangular and square screen printing frames are intended to support the screen mesh while maintaining an even strain on the screen at all points when ink is forced through the screen. Uneven screen tension causes uneven printing of the desired image. Hence, a rigid and strong frame is required to obtain the best results, requiring strong and lightweight components.

Typical screens are made out of wood or extruded aluminum hollow tubing side members with rectangular or square cross-sections. Each of these component materials has limitations. Welding the aluminum frames together is expensive and requires relatively thicker metal in the side members, thereby increasing the weight of the screen. Wooden frames must be cut and formed, then connected with fasteners and/or glue. Each frame requires a certain amount of manpower to manufacture from its component parts.

A recurring problem with screen printing frames is that they need to be washed with water regularly between uses. The solid wooden frames can warp or crack after repeated washings. While aluminum does not absorb water, a pinhole in a frame weld will allow water into the hollow frame interior.

Plastic frames are light-weight and low-cost, but a plastic hollow-tube frame is not strong enough to hold the tension on the silkscreen itself and still has to be cut and joined. A plastic screen with an open design and integral bracing members solves the weight and strength problem. Casting the frame in one piece is a low-cost solution.

None of the prior art screen frame devices have this approach, a single-piece injection-mold or casting of rigid material. The present invention differs from the state-of-the-art devices by virtue of its low-cost manufacture, its ease of assembly with the silk screen itself, and its self-drying capability.

BRIEF SUMMARY OF THE INVENTION

It is an object of this invention to provide a screen printing frame that is low-cost to manufacture.

It is an object of this invention to provide a screen printing frame that is light-weight, strong and durable in use.

It is a further object of this invention to provide a screen printing frame that is low-cost to manufacture.

Further objects of this invention can be discerned by perusing the detailed description, drawings, specifications and claims of this application.

BRIEF DESCRIPTION OF THE DRAWING

The construction and operation of the invention can be readily appreciated from inspection of the drawings that accompany this application, combined with the detailed specification to follow.

FIG. 2 is a cross-section diagram of the preferred embodiment of the invention.

FIG. 3 is a cross-section of the side of the frame.

DETAILED DESCRIPTION OF THE INVENTION

Figure 1:
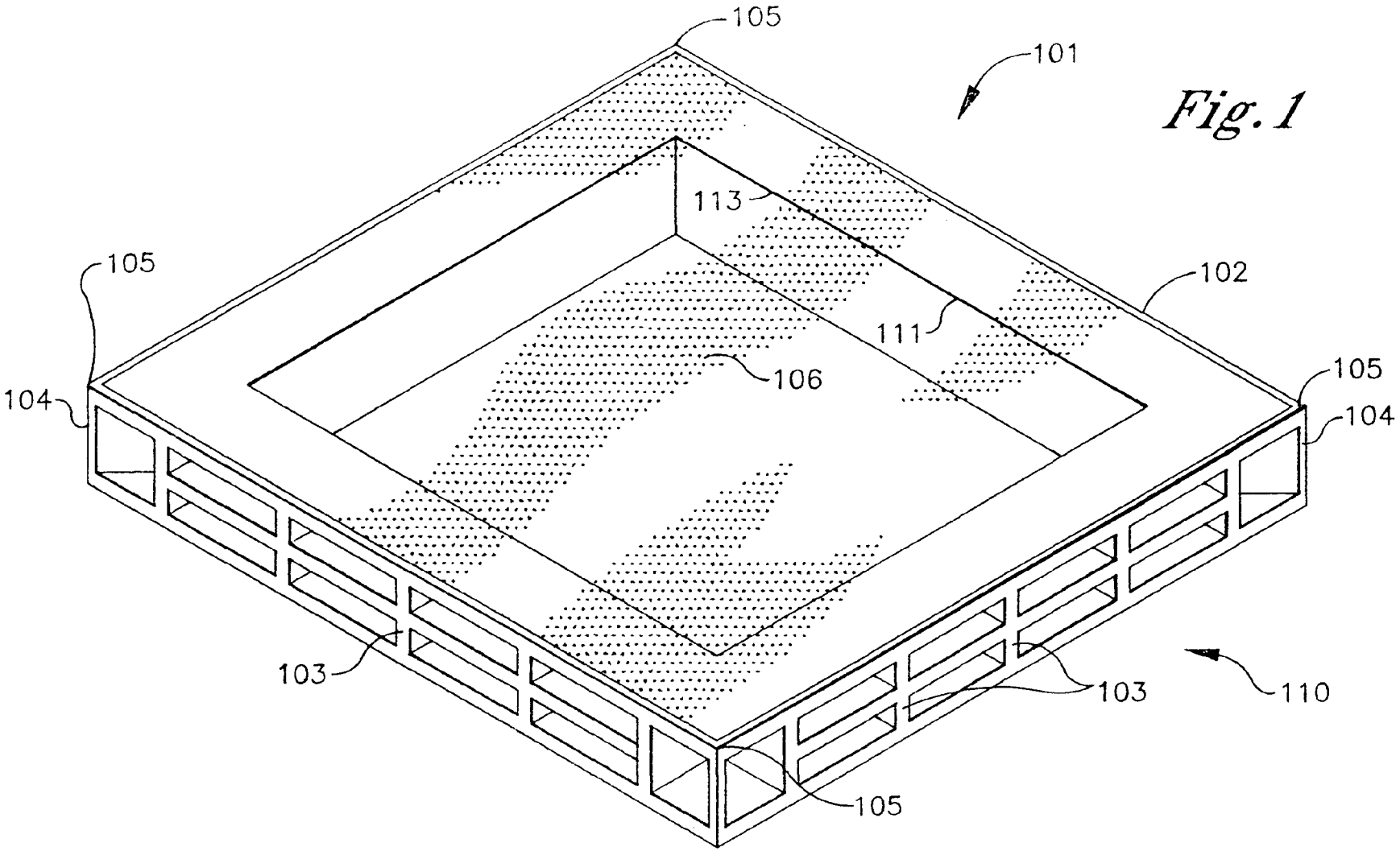
FIG. 1 is a perspective drawing of the preferred embodiment of the invention.
Figure 6:
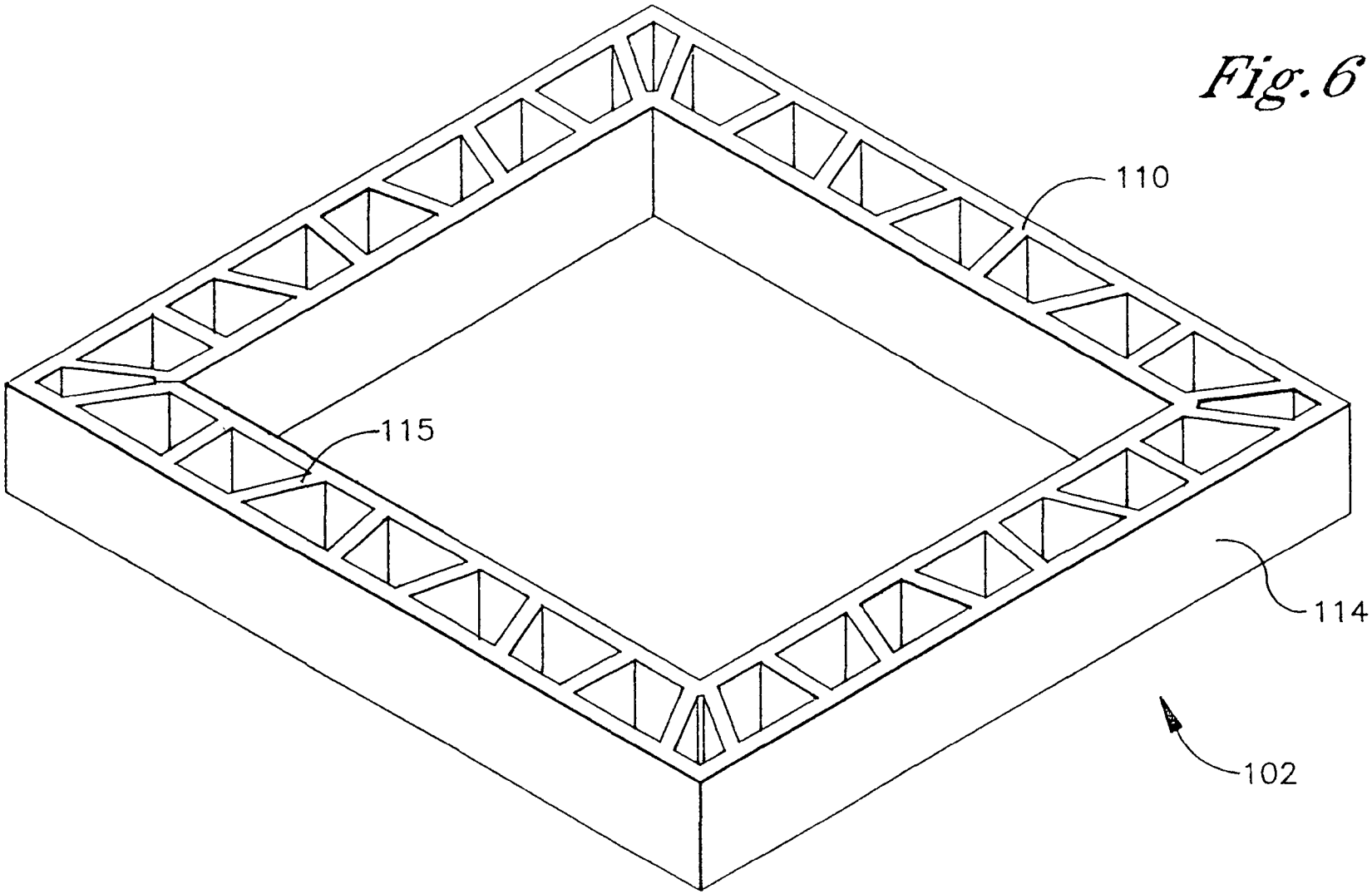
FIG. 6 is a bottom view of an alternative embodiment

The invention is best described by referring to the preferred embodiment illustrated in the drawing in FIG. 1. Referring to FIG. 1, a one-piece injection-molded or cast screen printing frame (cast frame)[101] is a structure that resembles a picture frame, but the frame itself is not a solid piece of wood or a hollow metal tube. The cast frame[101] is a rectangular structure comprised of a single piece of cast material. The cast frame possesses a top edge[102], a bottom edge[110], an interior edge[111], and a plurality of support ribs [103] which, in the preferred embodiment, are parallel to the top and bottom edges[102,110] of the cast frame[101] and perpendicular to the interior edge[111]. In other embodiments, these support ribs[103] could be cast such that they form an angle to the top and bottom edges[102,110]. In a particular alternate embodiment, illustrated in FIG. 6, the bottom edge[110] can possess bottom support ribs[115] while the sides[114] and top[102] are solid.

Figure 4:
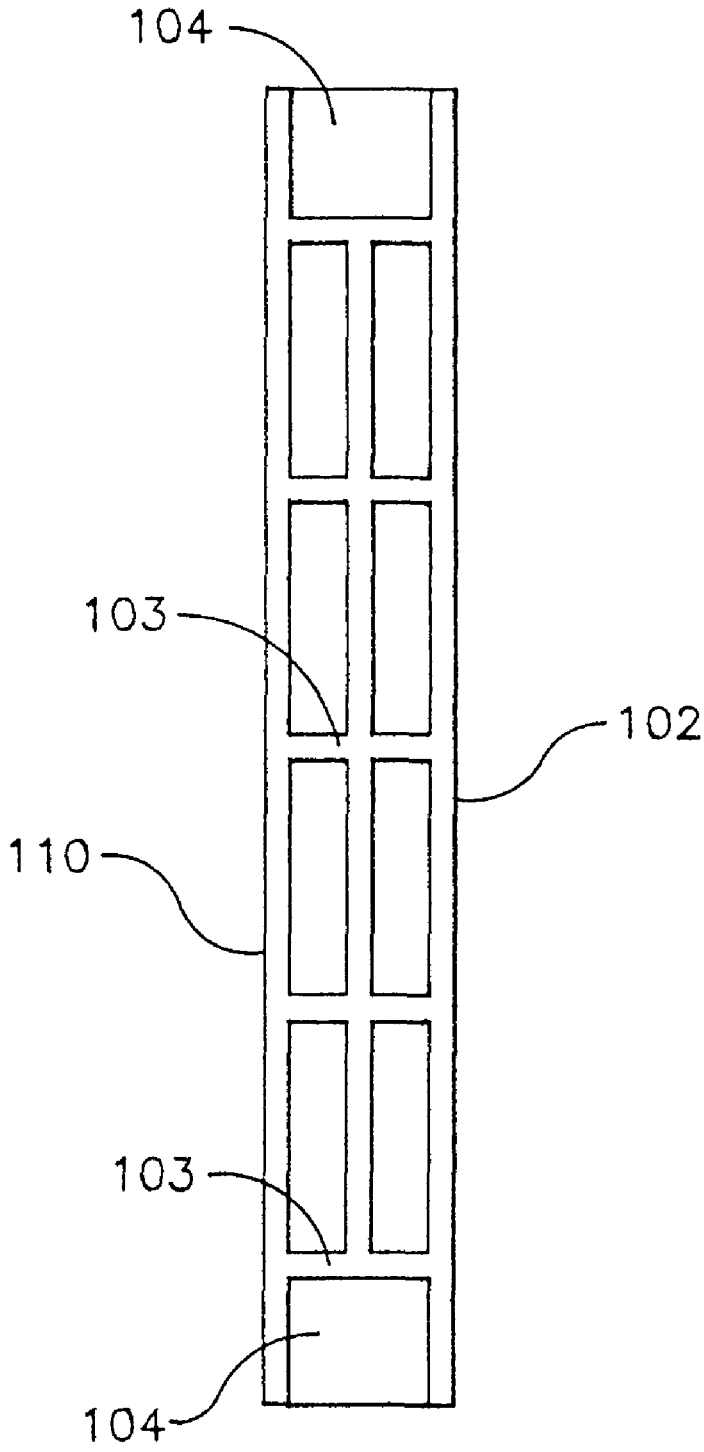
FIG. 4 is side view of the invention.
Figure 5:
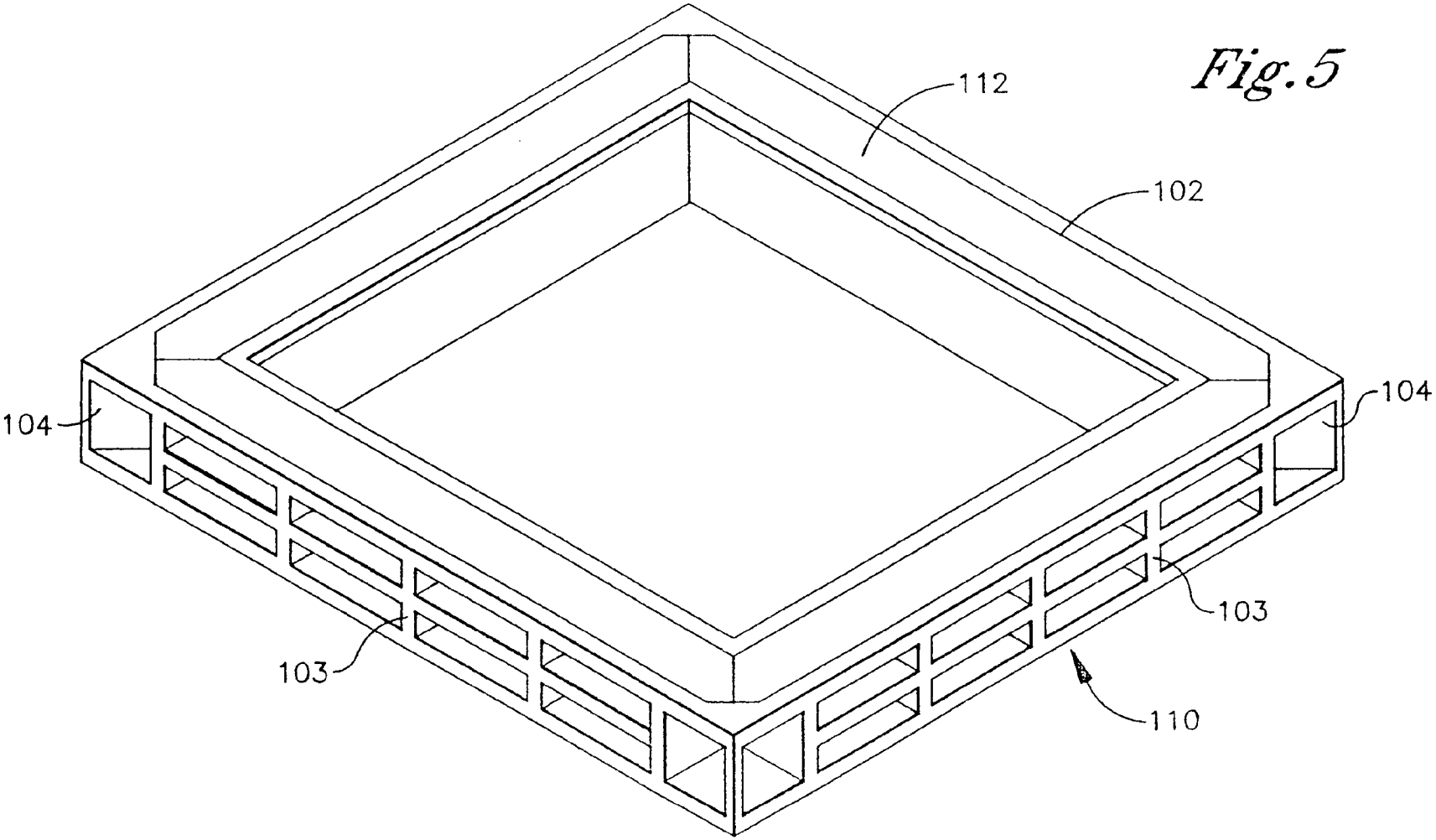
FIG. 5 is a perspective view of an alternative embodiment

A corner support rib[104] is placed in each corner[105] of the plastic frame[101] as shown in FIGS. 1, 2, and 4, and each corner support rib[104] is merged into the one-piece cast frame[101] and the support ribs[103]. The corner support ribs are perpendicular to the support ribs[103] and the top[102] and bottom edges[110]. They run from the apex of the corner[112] to the angle[113] of the interior edge[111].

The silk screen fabric[106] is fixedly attached to the top surface of the cast frame. The silk screen fabric 106 can be made from a number of different materials including polyester and metal.

The cast frame[101] itself can be made of several materials, including nylon, styrene, polypropylene, or metal. Metals include aluminum. The preferred embodiment of this invention is a cast plastic frame[101] and a polyester silk screen fabric[106] with the silk screen fabric[106] attached to the frame[101] by means of adhesive.

A further alternative embodiment of this invention, where the plastic used for the cast frame[101] will not hold the silk screen[106] adequately, the silk screen[106] being attached by means of adhesive, is to add an aluminum or steel liner[112] to the top edge[102] of the cast frame[101], the liner fixedly attached to the top edge[102] of the cast frame[101] by mechanical means, by being cast into the top edge[102] when the cast frame[101] is made, or by means of adhesive, the silk screen fabric[106] then connected fixedly to the liner by means of adhesive.

Another alternative embodiment of the cast frame[101] is where the frame sides[114], inside and outside, are bowed in an outwards direction slightly to give the cast frame[101] added strength when the silk screen fabric[106] is stretched over it. The bowed shape confers strength and stability to the sides[114] when under the stress of the stretched silk screen fabric[106].

While the foregoing describes a preferred embodiment and several alternative embodiments, variation on this design and equivalent designs may be resorted to in the scope and spirit of the claimed invention.

What is claimed is:

1. A screen printing frame and screen, the screen printing frame comprised of a single piece of material, the single piece of material possessing a rectangular shape, the rectangular shape comprised of four sides, the sides possessing four interior edges, a top edge, four outside edges, a bottom edge and a plurality of support ribs, the screen comprised of a fabric, the screen stretched over the top edge of the screen printing frame, the screen fixedly attached to the screen printing frame, the plurality of support ribs disposed between and parallel to the top edge and the bottom edge and perpendicular to the interior edge, the plurality of support ribs merged solidly into the material of the interior edge and running longitudinally down each side of the rectangular shape.

2. A screen printing frame and screen, the screen printing frame comprised of a single piece of material, the single piece of material possessing a rectangular shape, the rectangular shape comprised of four sides, the sides possessing four interior edges, a top edge, four outside edges, a bottom edge and a plurality of support ribs, the screen comprised of a fabric, the screen stretched over the top edge of the screen printing frame, the screen fixedly attached to the screen printing frame, the top edge of the screen printing frame inlaid with a metal liner, the metal liner attached fixedly to the top edge of the screen printing frame, the upper surface of the metal liner flush with the top edge of the screen printing frame, the screen attached fixedly to the metal liner.

3. A screen printing frame and screen, the screen printing frame comprised of a single piece of material, the single piece of material possessing a rectangular shape, the rectangular shape comprised of four sides, the sides possessing four interior edges, a top edge, four outside edges, a bottom edge and a plurality of support ribs, the screen comprised of a fabric, the screen stretched over the top edge of the screen printing frame, the screen fixedly attached to the screen printing frame, the four sides of the screen printing frame bowed outwards slightly to confer greater strength to the screen printing frame.

* * * * *